US006059927A

United States Patent [19]

Wan et al.

[11] Patent Number: 6,059,927

[45] Date of Patent: May 9, 2000

[54] **METHOD OF REDUCING BRIGHTNESS REVERSION AND YELLOWNESS (B*) OF BLEACHED MECHANICAL WOOD PULPS**

[75] Inventors: Jeffrey K.-S. Wan; M. Catherine Depew, both of Kingston, Canada

[73] Assignee: Queen's University at Kingston, Kingston, Canada

[21] Appl. No.: 08/936,200

[22] Filed: Sep. 23, 1997

[51] Int. Cl.[7] ..... D21C 3/20; D21C 9/10

[52] U.S. Cl. ..... 162/72; 162/90

[58] Field of Search ..... 162/72, 77, 90

[56] References Cited

U.S. PATENT DOCUMENTS 2,071,305 2/1937 Hirschkind et al. .
2,071,309 2/1937 Hirschkind et al. .
2,298,260 10/1942 Kantorowier et al. .
3,124,503 3/1964 Zachariasen et al. .
3,479,249 11/1969 Kalisch et al. .
3,617,435 11/1971 Ealisch .
4,004,967 1/1977 Swan et al. .
4,016,029 4/1977 Samuelson .
4,481,073 11/1984 Sakai et al. .
5,080,754 1/1992 Francis et al. .

*Primary Examiner*—Steven Alvo
*Attorney, Agent, or Firm*—Richard J. Hicks; Carol Miernicki Steeg

[57] ABSTRACT

A method for reducing brightness reversion and yellowness (b*) of bleached mechanical wood pulps. The pulp is digested in an aqueous formaldehyde solution containing carbonate, preferably in an amount up to 30% by weight of pulp. Paper made from the digested pulp can be further improved by treating with a reversion inhibitor such as a polyethylene glycol bisthiol.

14 Claims, 2 Drawing Sheets

METHOD OF REDUCING BRIGHTNESS REVERSION AND YELLOWNESS (B*) OF BLEACHED MECHANICAL WOOD PULPS

FIELD OF INVENTION

This invention relates to the manufacture of paper and, more particularly, to the bleaching of mechanically-produced pulps, particularly softwood, containing lignin so as to reduce yellowness and improve brightness.

BACKGROUND OF INVENTION

Mechanically-produced pulps, softwood and thermomechanical pulps containing lignin, as opposed to chemically produced wood pulps, used for the production of paper, have traditionally been bleached to improve the whiteness thereof. Newsprint, which contains a relatively high lignin content is either not bleached or only mildly bleached, with the result that it is usually of a darker quality than paper produced from fully bleached pulp, and tends to darken further when exposed to light, a phenomenon known as "reversion".

Whiteness or "brightness" of paper is conventionally measured by brightness measurements based on the reflectance of light at a wavelength of 457 nm, using such instruments as an Elrepho brightness meter. There is, however, another measure of whiteness which is even more significant and that is the degree of yellowness (CIE yellow colour coordinate b*). Bleached softwood pulps usually have a brightness of about 70–90% Elrepho and a yellowness b* of 8 or more, and there are several known methods for achieving these results, using either an oxidative process using hydrogen peroxide under strongly basic conditions or reductive processes using hydrosulfite (dithionite) or combinations thereof. Attention is also directed to U.S. Pat. No. 5,080,754, issued Jan. 14, 1992, to Francis et al., which describes the use of alkali formates (Na, Mg and Ca formates) and compounds having a formyl functionality, RCHO, including formamides, formic acid esters and formylurea, to improve brightness reversion of bleached mechanical and semi-mechanical pulps and papers. This patent, however, specifically excludes formic acid and formaldehyde and there is no attempt to either increase initial ISO brightness or to reduce b* values.

There is an ongoing need for improved but inexpensive mechanical and thermo-mechanical pulps having improved brightness and decreased b* values; and with greater stability of the optical properties, i.e. decreased reversion.

OBJECT OF INVENTION

An object of the present invention is to provide improved mechanical and thermo-mechanical pulps having increased brightness of 5 to 8% over previous values and a decreased b* value of up to 4 points or greater than 30% to a value below 6.

BRIEF DESCRIPTION OF INVENTION

By one aspect of this invention, there is provided a method for reducing brightness reversion and yellowness (b*) of bleached wood pulps containing lignin, comprising digesting said pulp in an aqueous formaldehyde solution containing carbonate at ambient temperature.

DETAILED DESCRIPTION OF PREFERRED EMBODIMENTS

Figure 1:
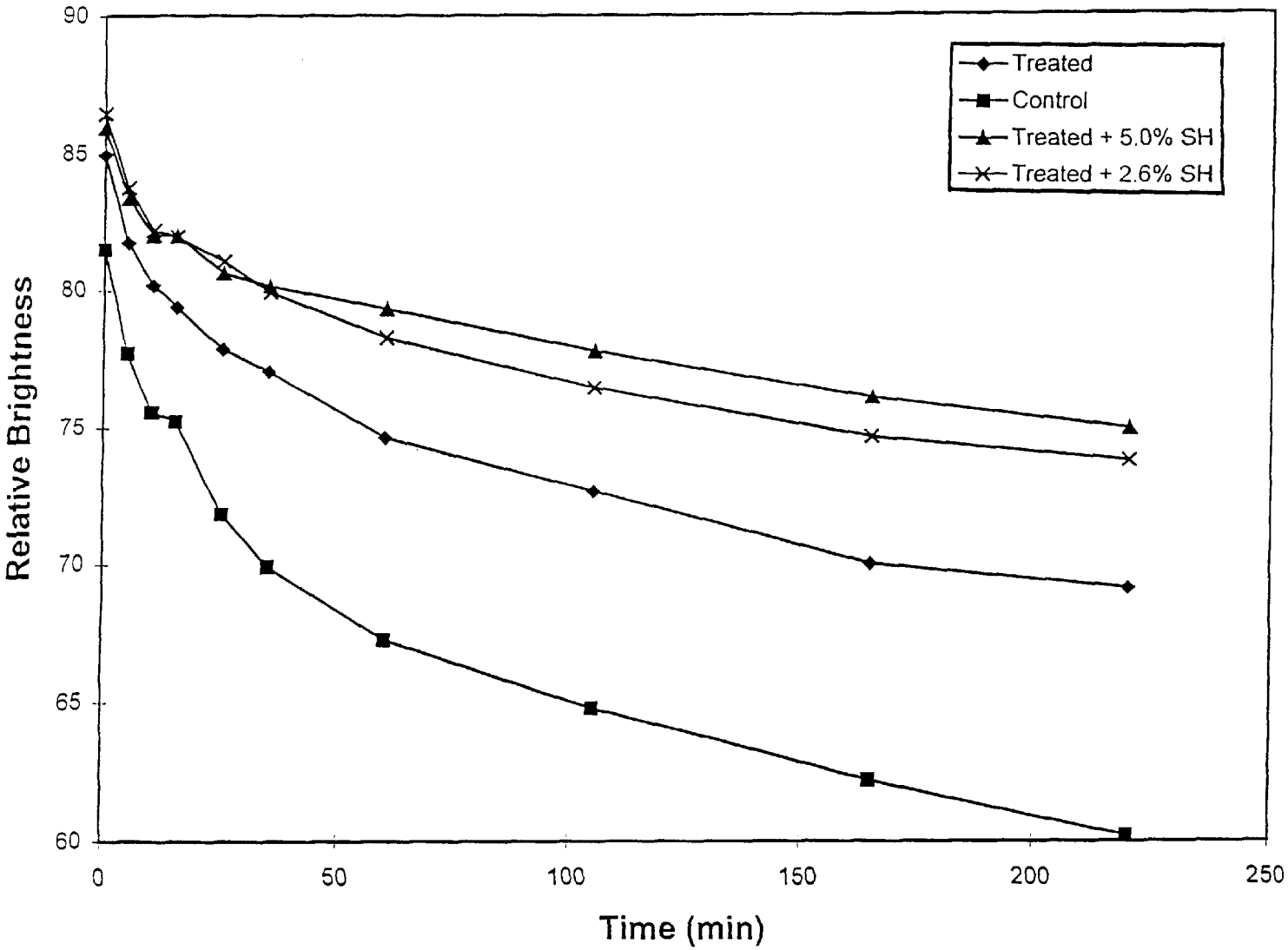
FIG. 1 is a graph illustrating reversion of softwood TMP handsheets treated with formaldehyde/carbonate and of softwood TMP handsheets treated with formaldehyde/carbonate and then sprayed with polyethylene glycol (1700) bisthiolactate.

Although several attempts have been made to improve brightness of unbleached pulps using formaldehyde in combination with other additives such as methanol, ethanol, isopropanol, glycerol, sorbitol, formic acid or acetone and alkaline oxygen bleaching to achieve at least partial delignification, no one appears to have considered the problems of improving b* values in such pulps without significant delignification. Surprisingly, we have found that b* values in bleached pulps can be improved significantly by digestion of the pulp in an aqueous formaldehyde solution containing up to about 30% by weight of pulp of carbonate. Preferably, the formaldehyde solution is in the range of 30 to 40% by weight formaldehyde and, more preferably, about 37% formaldehyde. The carbonate is preferably in the form of an alkali or alkaline earth metal carbonate such as sodium, calcium or magnesium carbonate.

EXAMPLE 1

5 g of a softwood TMP (dry 4% $H_2O_2$ bleached spruce TMP from Kruger Inc.) was mixed with a 37% formaldehyde solution in water (80 ml) and 6 g sodium carbonate. The mixture was digested, without stirring, for 2 to 4 days, at ambient temperature, and then the pulp slurry was either filtered and washed with water or neutralized to pH7 and filtered without washing. Handsheets were then made from the resultant pulp, analyzed by standard industry standards (Pulp and Paper Research Institute of Canada), and compared to similar handsheets made from untreated pulp as controls. The results are tabulated in Table 1 below.

TABLE 1

| Sample | Grammage (O.D.) ($g/m^2$) | Bulk SS ($cm^2/g$) | Burst Index ($kPa \cdot m^2/g$) | Tear Index ($mN \cdot m^2/g$) | Z-Span Brklgth (km) | Brightness Top % | L* Top | a* Top | b* Top |
|---|---|---|---|---|---|---|---|---|---|
| Control | 58.0 | 2.74 | 2.39 | 8.15 | 9.99 | 75.09 | 94.65 | −1.93 | 9.59 |
| Treated | 61.4 | 2.88 | 2.34 | 9.71 | 10.59 | 81.41 | 95.69 | −1.46 | 6.26 |

EXAMPLE 2

5 g of a single stage bleached TMP pulp (Abitibi Price, Beaupre, Quebec) (bleached with 5% $H_2O_2$, 7% NaOH, 3% $Na_2SiO_3$, 0.05% $MgSO_4$ and 0.2% DTPA) was mixed with a 37% formaldehyde solution in water (80 ml) and 6 g sodium carbonate. The mixture was digested and filtered as described in Example 1 and handsheets were prepared from the treated pulp and an untreated pulp as control. Similar results to those of Table 1 were obtained as shown in Table 2.

TABLE 2

| Sample | Brightness, % Top | b* Top |
|---|---|---|
| Control | 81.8 | 7.99 |
| Treated | 84.2 | 5.66 |

From Examples 1 and 2, it can be seen that the formaldehyde/carbonate treatment is a mild reductive treatment applicable to bleached softwood (or hardwood) pulps which can be carried out at ambient temperatures and pressure and which does not use strongly acidic or basic conditions which might delignify the pulp. Therefore, no appreciable reduction in the yield of the pulp occurs, but the treatment substantially improves the optical brightness, whiteness and, as shown below, stability of these optical properties of resulting papers formed from such pulps. Although the mechanisms by which this mild reductive treatment accomplishes the significant enhancements in b* and brightness values are incompletely understood, and without wishing to be bound by this explanation, it is believed that the action of carbonate in water on formaldehyde results in the formation of a "super reducing agent" as shown below:

$$CO_3^{=}+H_2CO \leftrightarrows HCO_3^{-}+HCO^{-}$$

The action of the "super reducing agent", or the formaldehyde anion, is to attack chromophores such as conjugated double bonds, both aromatic and aliphatic, in the lignin reducing them to structures absorbing at shorter wavelengths, i.e. making the pulp appear less yellow. Such chromophores are resistant to the bleaching actions of hydrogen peroxide and hydrosulfite and are largely responsible for the residual yellow appearance of bleached softwood pulps. This mechanism is consistent with the observation that additions of base such as sodium hydroxide to the formaldehyde/carbonate system inhibit the reactions and do not give pulps having similar increases in brightness and decrease in b* values.

Figure 2:
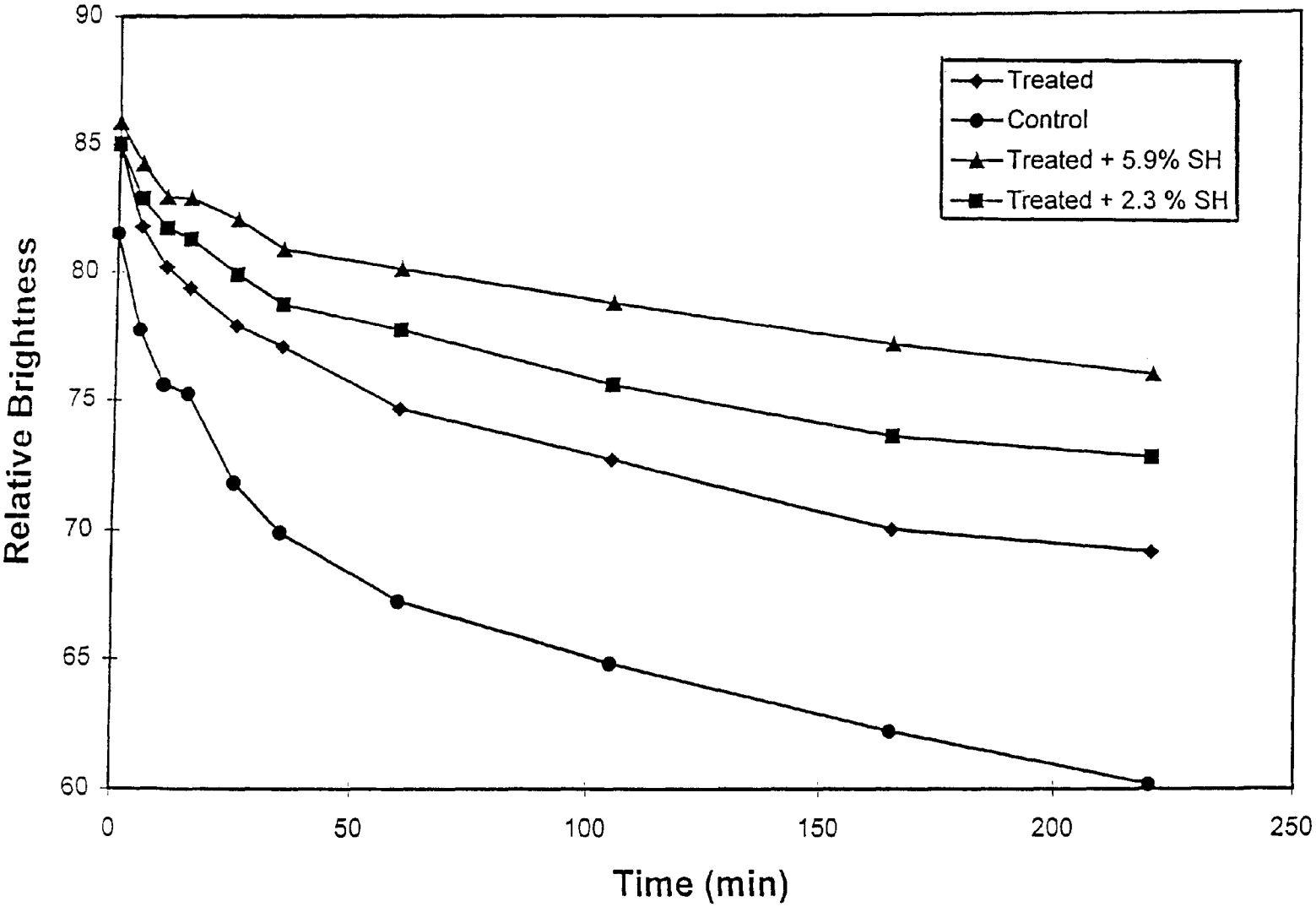
FIG. 2 is a graph illustrating reversion of softwood TMP handsheets treated with formaldehyde/carbonate and of softwood TMP handsheets treated with formaldehyde/carbonate and then sprayed with polyethylene glycol (2000) bisthiolactate.

Not only does the treatment method described significantly enhance the ISO brightness and b* characteristics of bleached softwood mechanical pulps, it also improves the stability of these characteristics to light-induced reversion. In accelerated photoreversion experiments done in a custom built photoreactor under eight 350 nm uv lamps, papers made from the treated pulps photoyellowed much more slowly than papers made from the control (untreated) bleached TMP pulps, especially during initial irradiation. This, combined with the substantially enhanced initial optical properties, leaves the papers appearing still very white, even after >10 hr irradiation. Selected data are shown in FIGS. 1 and 2.

An even greater decrease in the reversion rate can be obtained if the formaldehyde/carbonate treated pulps are further treated by some reversion inhibitor such as the polyethylene glycol bisthiols described in our earlier filed patent application (U.S. Ser. No. 08/261,275 (1996)), now abandoned, and in our paper (Wan et al., "Some mechanistic insights in the behaviour of thiol containing antioxidant polymers in lignin oxidation processes", Res. Chem. Inter. 22: 241–253 (1996)), the disclosures of which are incorporated herein by reference. In addition to the treated and control pulps, data for reversion of the pulps having 2 to 6% of the polyethylene glycol bisthiolactate or polyethylene glycol bisthioglycolate polymers previously described is included (FIGS. 1 and 2). FIG. 1 shows the comparison of the reversion behaviour of handsheets made from single stage bleached softwood TMP (Abitibi-Price, Beaupre, Quebec): untreated (—■—), treated with formaldehyde/sodium carbonate (—♦—), treated and then sprayed with an aqueous solution of 2.6% (—×—) or 5.0% (—▲—) polyethylene glycol (1700) bisthiolactate. FIG. 2 shows the comparison of the reversion behaviour of handsheets made from single stage bleached softwood TMP (Abitibi-Price, Beaupre, Quebec): untreated (—●—), treated with formaldehyde/sodium carbonate (—♦—), treated and then sprayed with an aqueous solution of 2.3% (—■—) or 5.9% (—▲—) polyethylene glycol (2000) bisthiolglycolate. These polymeric thiols are effective radical scavengers which are believed to inhibit free radical-induced processes which discolour the lignin in the pulp.

We claim:

1. A method for reducing brightness reversion and yellowness (b*) of bleached wood pulps containing lignin, comprising treating bleached wood pulp containing lignin in an aqueous formaldehyde solution containing carbonate selected from the group consisting of alkali and alkaline earth metal carbonates at ambient temperature under conditions that the brightness reversion and yellowness of the bleached pulp are reduced, wherein the aqueous solution contains 30–40% by weight formaldehyde and wherein said solution does not contain sodium hydroxide.

2. A method as claimed in claim 1 wherein said carbonate is present in an amount up to about 30% by weight of said pulp.

3. A method as claimed in claim 2 wherein said carbonate is selected from the group consisting of sodium, calcium and magnesium carbonates.

4. A method as claimed in claim 1 wherein said aqueous formaldehyde solution contains 37% by weight formaldehyde.

5. A method as claimed in claim 1 including the step of filtering said pulp and washing with water after said treating step.

6. A method as claimed in claim 5 including treating said pulp with a polyethylene glycol bisthiol reversion inhibitor.

7. A method as claimed in claim 6 wherein said reversion inhibitor is selected from the group consisting of polyethylene glycol bisthiolactate and polyethylene glycol bisthioglycolate.

8. A method as claimed in claim 1 including treating said pulp with a polyethylene glycol bisthiol reversion inhibitor.

9. A method as claimed in claim 8 wherein said reversion inhibitor is selected from the group consisting of polyethylene glycol bisthiolactate and polyethylene glycol bisthioglycolate.

10. A method as claimed in claim 1 wherein said pulp is softwood.

11. A method as claimed in claim 1 wherein said pulp is hardwood.

12. A method as claimed in claim 1 wherein said carbonate is sodium carbonate and the method further comprises the step of neutralizing said solution.

13. A method as claimed in claim 1 wherein said carbonate is calcium carbonate.

14. A method as claimed in claim 1 wherein said carbonate is magnesium carbonate.

* * * * *